United States Patent [19]

Voss

[11] 4,066,133

[45] Jan. 3, 1978

[54] POWER HAND TOOL

[75] Inventor: Klaus Voss, Stuttgart, Germany

[73] Assignee: Robert Bosch G.m.b.H., Stuttgart, Germany

[21] Appl. No.: 609,309

[22] Filed: Sept. 2, 1975

[30] Foreign Application Priority Data

Sept. 4, 1974 Germany ..... 2442226

[51] Int. Cl.² ..... B25B 23/14

[52] U.S. Cl. ..... 173/12; 73/136 R; 73/139; 81/52.4 R

[58] Field of Search ..... 173/12; 73/136 R, 139; 81/52.4, 52.5; 310/47, 50, 68 B; 91/59; 415/40; 408/9; 144/32 R

[56] References Cited

U.S. PATENT DOCUMENTS

| | | | |
|---|---|---|---|
| 809,394 | 1/1906 | Pederson | 310/68 B X |
| 964,197 | 7/1910 | Backscheidner | 310/50 X |
| 2,431,316 | 11/1947 | Dudley et al. | 310/68 B X |
| 2,793,305 | 5/1957 | Gerentes | 310/68 B |
| 3,180,612 | 4/1965 | Spyridakis et al. | 91/59 X |
| 3,858,443 | 1/1975 | Roberts et al. | 73/136 R |

*Primary Examiner*—Ernest R. Purser

*Attorney, Agent, or Firm*—Flynn & Frishauf

[57] ABSTRACT

To prevent accidents due to high torque of hand tools, such as drills, and the like, which, when the tool bit stalls, may tend to twist the tool handle from the user's hand, a torque measuring element is located on the tool body at the junction of the tool body and the handle and connected to the power supply of the tool to discontinue or interrupt power supply thereto upon sensing of deformation between the tool body and the handle thereof due to excessive strain on said junction; preferably, the handle is joined to the tool body by a section of material of reduced cross-sectional size to accentuate any deformation between the tool handle and the body.

16 Claims, 7 Drawing Figures

Fig. 5
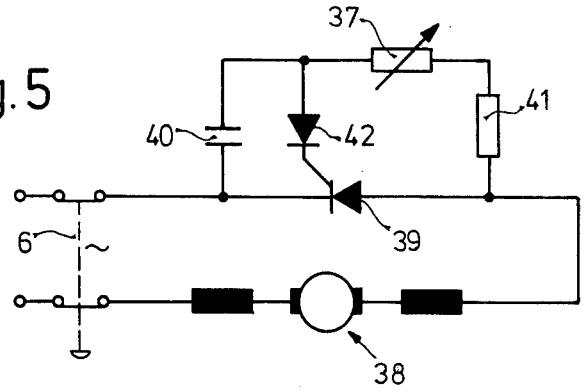
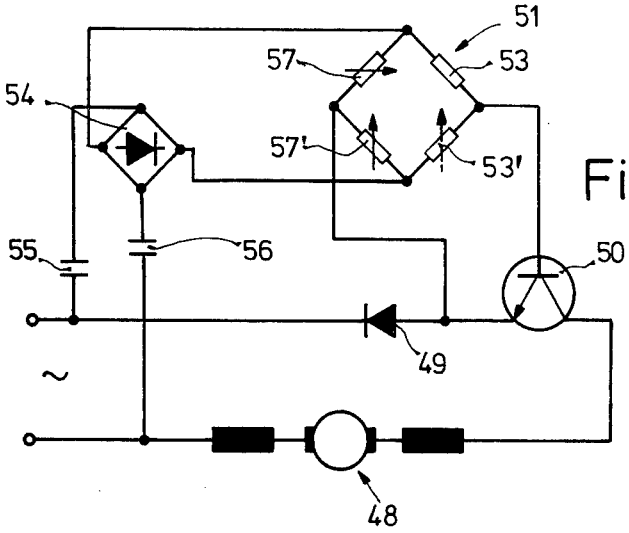
Fig. 6
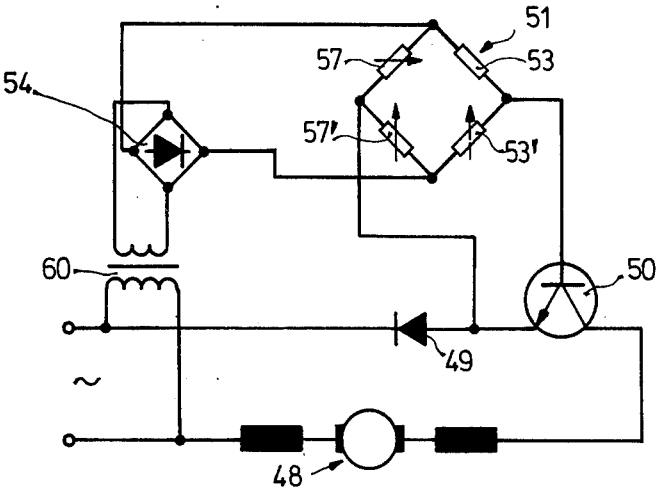
Fig. 7

POWER HAND TOOL

The present invention relates to motor-driven hand tools having a handle adapted to be held by an operator.

The power of recent hand tools is increasing constantly. This is particularly true for electrical hand tools. Hand tools of ever higher torque output are available. If a tool element inserted in such a hand tool is prevented from rotation, dangerous conditions and accidents involving the operator of the tool may result: for example, if the tool is a drill, and the drill bit freezes, or binds in the work piece, the torque which can normally be counteracted by the operator holding the tool, may cause injury due to the torque applied by the handle on the operator's hand. In extreme cases, the tool itself may be twisted out of the operator's hand, and at least for a short period of time spin freely.

It is an object of the present invention to provide a hand tool adapted to be hand-held by an operator, in which dangerous conditions arising due to excessive torque capabilities of the tool are eliminated.

SUBJECT MATTER OF THE PRESENT INVENTION

Briefly, a torque sensing element is so arranged on the tool that torque transmitted to the operator is sensed and when a certain level is exceeded, the tool is slowed, or disconnected from its energy supply.

The drive motor of the tool can be controlled in dependence on the torque actually applied to the handle of the tool. The torque sensing element is a sensor which senses deformation of the tool handle with respect to the motor housing, or the tool body, respectively, of the tool itself. The torque measuring element is located on a region or zone of the junction of the tool handle with the tool body, which is particularly subject to deformation, or which is so formed or shaped that it will deform upon excessive torque between the tool body and the handle, for example in the region of decreased material cross section. The torque sensing element may be so arranged that it completely disconnects the motor, or controls the speed of the motor, or the supplied torque thereof, and eventually may disconnect the motor. This is particularly easily accomplished if the tool is an electrical hand tool supplied by alternating current power, and equipped with a speed control circuit operating as a phase controller.

The invention will be described by way of example with reference to the accompanying drawings, wherein:

FIG. 5 is a schematic circuit diagram of another control system in accordance with the present invention;

FIG. 6 is a schematic diagram of yet another control system; and

FIG. 7 is a schematic diagram of yet another control system.

Figure 1:
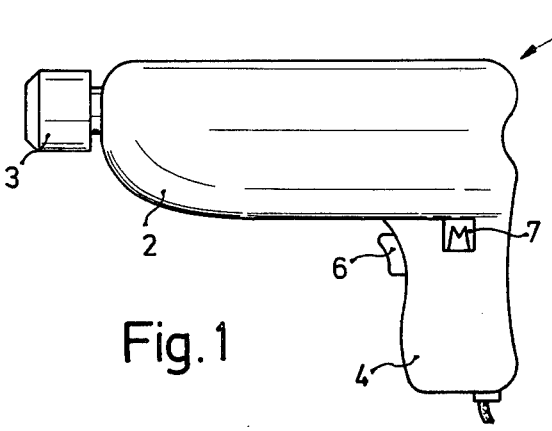
FIG. 1 is a highly schematic side view of an electrical drill.

The drill 1 (FIG. 1) has an essentially cylindrical housing 2 in which an electrical drive motor is located and, as is customary, a reduction gearing, connected to a chuck 3. The end of the housing 2, remote from the chuck 3, has a handle connected thereto, shown as a pistol grip 4. The junction between the handle 4 and the tool body 2, or the handle 4 itself in a region closely adjacent the junction, is formed with a region of constricted material cross section 5. A customary press switch 6 is located on the forward portion of the pistol grip 4, electrically connected to a motor (not shown) within the body 2.

The constricted region 5 which, due to its shape and reduced material content, is particularly subject to deformation upon torque being transmitted from the body 2 to the handle 4. A torque measuring element 7 is located in that region 5. The tool of FIGS. 1 and 2 has a housing which is made of plastic, and the torque measuring element can be inserted directly in the wall of the housing in such a construction, that is, may be placed directly at the junction or approximately at the junction of the handle 4 and the tool body 2, for example by being molded therein. If the housing is made of metal, the torque sensor 7 may require separate attachment. The torque sensor 7, preferably, is an electrical resistor which has a resistance value which depends on mechanical stress placed thereon, that is, an electrical output strain gauging strip. The strain gauging strip or torque-electrical signal transducer 7 is located at one side of the handle 4, and preferably located at that side which, considering the direction of rotation schematically indicated by arrow A (FIG. 2) which tends to twist the tool away from the handle 4. This torque may reach high values if a drill inserted in chuck 3 binds or jams in a bore hole of the work piece, in which case full machine power is applied between the handle 4 and the tool body 2. The change in resistance of the strain resistor 7 is an electrical measure for the mechanical deformation of the tool within the region 5 of reduced cross section, which, in turn, is a measure of the force acting on the handle 4. Multiplied with the lever arm, the effective torque can be obtained.

Figure 2:
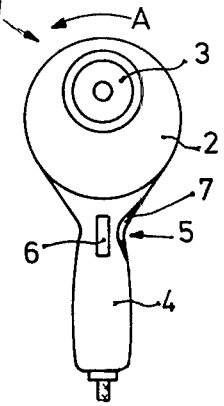
FIG. 2 is a front view of the drill of FIG. 1.
Figure 4:
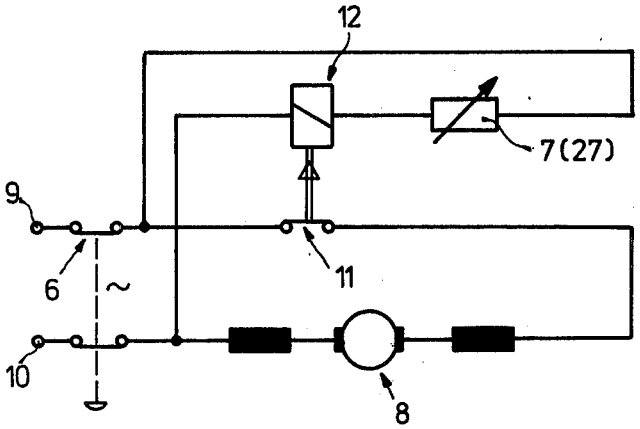
FIG. 4 is a schematic circuit diagram of an embodiment of the present invention applied to the drill of either FIGS. 1 and 2, or FIG. 3.

The circuit associated with the tool of FIGS. 1 and 2 is illustrated in FIG. 4. A universal, that is, series motor 8 is connected to a source of alternating current supply, applied to terminals 9, 10. The switch 6, which is normally open, connects and disconnects the terminals 9, 10 to the motor 8. A further switch 11 is included in series with the motor 8 which is controlled by a relay 12. The coil of the relay 12 is connected across the motor 8, in series with the strain resistor 7.

Operation: A spring normally holds the switch contacts connecting the main terminals 9, 10 in open condition. Upon depressing of switch 6, the contacts will close and assume the position shown in FIG. 4. Relay 12 will be energized, so that switch contacts 11 will be closed. The motor 8 will start. The operator holding the drill 1 can use the drill under normal power supply, for example to drill a hole. The resistance of the strain measuring resistor 7 is so dimensioned that the current flowing through the resistor 7 is just sufficient to hold the relay 12 in the position in which the switch 11 is closed. If the drill should bind in the whole, the torque delivered by the motor 8 becomes effective on the pistol grip 4; as a result, the pistol grip 4 will deform with respect to the tool housing 2, particularly in the region of reduced cross section 5. This deformation elongates the torque sensor 7, thus increasing the resistance thereof, which rises rapidly, so that the current flowing through the resistor 7 as well as through the relay coil 12 is no longer sufficient in order to hold relay 12 in the closed position drawn in FIG. 4; as a result, the armature and the switch contact 11 will drop out, thus interrupting current to the motor 8. The relay 12 is so designed that it has a definite hysteresis, or a re-connect time delay, so that the operator has sufficient time to release the handle 6 or, if supplied with a separate lock button, to completely disengage and disconnect the switch button 6. Injury to the operator due to the torque which suddenly becomes effective on the grip 4 can thus be effectively prevented.

Figure 3:
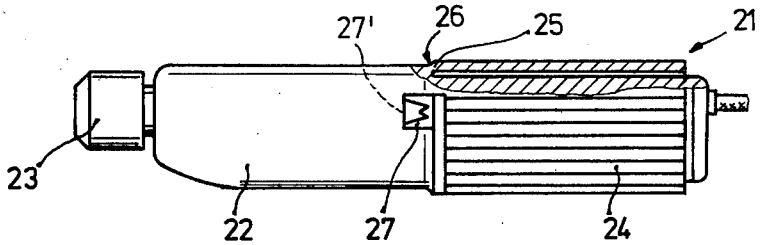
FIG. 3 is a highly schematic side view of another embodiment of an electrical drill having an in-line handle.

FIG. 3 illustrates an embodiment of the invention applied to a cylindrical in-line drill 21. Drill 21 has an essentially cylindrical housing 22 in which a universal motor and a reduction gearing are included, driving a chuck 23. A handle 24 is located at the end remote from chuck 23. Handle 24 is joined to the motor or tool body 22; the outside thereof is corrugated or knurled to increase friction and the holding grip by the operator. The part section shown in FIG. 3 shows that the handle 24 is sleeve-like and surrounds the inner housing 22 of the tool 21. The wall of the handle 24 is narrowed to a region 25, that is, to a region of reduced cross section of material. This narrowed portion is at the foreward or leading end of the handle 24, that is, at the end closest to the chuck 23. The reduced region 25 merges with the housing 22 of the machine 21 over a rounded section 26. A torque or strain measuring element 27 is located in the wall of the housing at the region which, due to its shape, in space, and due to its reduced cross section is particularly subjected to mechanical loading. The strain element 27 is identical to strain element 7 (FIGS. 1, 2, 4) and operates similarly. Any excessive torque applied to the handle 24 increases the resistance of the strain resistor 27 to such an extent that a switch located in the supply circuit to the motor will disconnect the current thereto.

A similar strain gauge 27′ may be located diametrically opposite; its function will be explained in connection with the circuits of FIGS. 6 and 7.

FIG. 5 shows the circuit for control of a series motor 38, the speed of which is controlled by an electronic phase control circuit. The motor 38 is connected in the main circuit of a thyristor 39. The thyristor 39 is bridged by a capacitor 40, a limiting resistor 41 and a strain resistor 37, similar to elements 7, 27 of FIGS. 1 and 3. The gate of thyristor 39 is connected over a trigger diode 42 to the junction of the capacitor 40 and the resistance series circuit formed of resistor 41 and strain gauge resistor 37. The series motor 38 can be used in the tool of FIGS. 1, 2 for example.

Operation: After pressing the switch level 6, to connect the switch elements connected thereto, capacitor 40 will charge if the half wave of the a-c supply has a polarity causing thyristor 39 eventually to conduct, but is still blocked, the charge capacitor 40 will be charged over the circuit including the strain gauge resistor 37 and the limiting resistor 41. When the capacitor voltage across capacitor 40 reaches the breakdown voltage of the trigger diode 42, trigger diode 42 becomes conductive and provides a firing pulse to the gate of thyristor 39. Thyristor 39 becomes conductive and charge of capacitor 40 ceases. The charge capacitor is initially discharged over the trigger diode and later on over the charge resistance including resistors 37, 41. If the strain gauge resistor 37 is stressed due to an excessive torque being applied between the handle of the tool and the body thereof, the resistance of resistor 37 will increase, thus shifting the firing time of the thyristor to a later instant during the half wave when thyristor 39 becomes conductive, thus decreasing the energy supply to the motor 38. Rather than using the thyristor, which is effective only during half waves, a triac can be used in a similar circuit.

FIG. 6 illustrates a series motor 48 operating in half-wave mode by being connected to the power supply through a series diode 49. A power transistor 50 controls current flow through motor 48. The base-emitter path of the transistor 50 is connected to respective diagonals of a bridge 51. Bridge 51 includes two fixed resistors 53, 53′ and two torque measuring elements 57, 57′. The torque measurement elements 57, 57′ can be located at opposite points of the pistol grip 4 of FIG. 1, that is, at opposite sides with respect to an imaginary plane of symmetry, or can be located on the tool of FIG. 3 as schematically indicated by 27, 27′, the element 27′ being diametrically opposite element 27, and not visible in the drawing. Bridge 51 is supplied from a rectifier 54 which is supplied by current through isolating capacitors 55, 56 which, in turn, are connected to the power mains. The voltage taken off bridge 51 at the diagonals is so adjusted that the transistor 50 is held in conductive state when the drill is in normal operation. When the resistance of the two sensing elements 57, 57′ changes upon deformation of the pistol grip, the bridge 51 is so unbalanced that transistor 50 will transfer to blocked state.

The circuit of FIG. 7 is identical to that of FIG. 6 except that the rectifier 54 supplying the bridge 51 is supplied by a transformer 60, rather than by capacitors 55, 56.

The bridge 51 of FIG. 6 or FIG. 7 should be so arranged that one of the resistors 57 and 57′ is normally somewhat stressed and the other is unstressed so that, upon excessive torque, the normally stressed element will relax, whereas the other element will strain, so that the shift in resistance values between the two elements at the diagonal junction is accentuated over that available from only a single one of the elements. The relative values of the resistances 53, 53′ can be so arranged that the proper base emitter voltage is applied to transistor 50 under normal operating conditions. The bridge circuit has some advantages since the connection of the strain responsive element 7, 27, or elements 27, 27′ can be varied widely to suit requirements. In principle, the bridge circuit can operate independently of any pre-stressing or biassing of the strain responsive strips. By pre-stressing or biassing, the bridge voltage will be larger. Such pre-stressing is not absolutely necessary, however, since it is sufficient that one of the strips is stressed when the tool is subject to excessive torque. One of the resistors 57, 57′ may also be a fixed resistor, having an adjustment value to set the unbalanced condition of the bridge. It is also possible to include two measuring elements, such as elements 57, 57′ which are stressed in the same direction; if this is the selected connection, then one of the elements 27 should be connected at the circuit position of the element 57 (FIGS. 6, 7) and the other one at the circuit position 53′, as indicated by the dashed lines through the resistor 53′. If the location of the elements and the arrangement are as indicated in FIG. 3, that is, if both the strain responsive elements are stressed in the same direction, then they should be located in diagonally opposite positions, that is, at the position of resistors 57, 53′, or 57′, 53, respectively.

The examples described used a strain gauge strip resistor as the torque measuring element; other transducer elements may be used, such as piezo-resistive elements, or such as voltage-dependent semiconductor resistors including silicon and germanium semiconductors. Such elements can readily be manufactured by an etching process similar to that used in integrated circuit technology already connected to other circuit components, for example as half bridge units. The output of the strain gauge transducer can be used to control any source of energy being supplied to the tool, electrical energy being the easiest one to control.

Various changes and modifications may be made and features described in connection with any one of the embodiments may be used with any of the others, within the scope of the inventive concept.

I claim:

1. Power hand tool having a tool body (2), a drive motor (8, 38, 48) secured in the body, and a holding handle (4, 24) for manually holding the tool, the holding handle being joined to the tool body, said tool comprising a torque sensing element (7, 27, 37, 57) located at the junction of the tool body and the handle and comprising a strain measuring transducer (7, 27, 37, 57) providing an electrical output signal, said strain measuring transducer being positioned on the tool adjacent the junction of the tool body and the holding handle to be responsive to deformation of the handle (4, 24) with respect to the tool body (2, 22);

and means connecting said strain measuring transducer and the motor to control the motor operation as a function of the output signal and thus of the torque between the tool body and the holding handle.

2. Tool according to claim 1, wherein the junction between the body (2, 22) and the handle (4, 24) is formed with a region of reduced material to provide for deformation of said region between the tool body and the holding handle upon excessive torque being delivered by the machine, the strain measuring transducer being located at said region of reduced material.

3. Tool according to claim 2, wherein the tool body is essentially cylindrical and has a plane of symmetry;

and two strain transducers are provided located at said junction and respectively at opposite sides of said plane of symmetry.

4. Tool according to claim 1, wherein the junction between the body (2, 22) and the handle (4, 24) is shaped to enhance deformation thereof upon excessive torque being delivered by the motor, the strain measuring transducer being located in the region of said junction.

5. Tool according to claim 4 wherein the tool body is essentially cylindrical and has a plane of symmetry;

and two strain transducers are provided located at said junction and respectively at opposite sides of said plane of symmetry.

6. Tool according to claim 1, wherein the torque sensing element (7, 27, 37, 57) is connected to control the speed of the motor (8, 38, 48).

7. Tool according to claim 1, wherein the torque sensing element (7, 27, 37, 57) is connected to disconnect a drive motor (8, 38, 48) from an energy source when the torque sensed by the torque sensing element exceeds a predetermined value.

8. Tool according to claim 1, wherein the strain gauge comprises a strain resistor strip.

9. Tool according to claim 1, wherein the strain gauge comprises a piezo-resistive element.

10. Tool according to claim 1, wherein the torque sensing element comprises at least two strain measuring transducers (27, 27'; 57), said transducers being differentially connected.

11. Tool according to claim 1, wherein the tool has a plane of symmetry and is an electrical tool, and two electrical strain measuring transducers are provided located at said junction and respectively at opposite sides of said plane of symmetry;

the strain measuring transducers being connected in a bridge circuit (51), the voltage taken off the diagonal of the bridge controlling the operation of the drive motor (48).

12. Tool according to claim 1, wherein the tool is an electrical tool, and a relay (11, 12) is provided having relay contacts (11) connected in the supply circuit to the drive motor, the current through the relay control coil (12) being controlled by the strain gauge transducer (7, 27).

13. Tool according to claim 12, wherein the relay has hysteresis characteristics to prevent immediate reclosing of the relay after the circuit to the drive motor has been interrupted.

14. Tool according to claim 1, wherein the tool is an a-c electrical tool, and a phase control thyristor (39) is connected in circuit with the drive motor (38), wherein the strain measuring transducer (37) is connected to control the firing angle of the thyristor (39).

15. Tool according to claim 1, wherein the torque sensing element (7, 27, 37, 57) is located in the wall of the tool body (2, 22) of the tool (1, 21).

16. Tool according to claim 15, wherein the tool body and the handle comprise a unitary plastic element, and the torque measuring element is molded into the plastic.

* * * * *

UNITED STATES PATENT AND TRADEMARK OFFICE

CERTIFICATE OF CORRECTION

PATENT NO. : 4,066,133

DATED : January 3, 1978

INVENTOR(S) : Klaus VOSS

It is certified that error appears in the above-identified patent and that said Letters Patent are hereby corrected as shown below:

Correct serial number of the German Priority Application to read: 24 42 260.

Signed and Sealed this

Ninth Day of May 1978

[SEAL]

Attest:

RUTH C. MASON
Attesting Officer

LUTRELLE F. PARKER
Acting Commissioner of Patents and Trademarks